US007975479B2

(12) United States Patent
Altin et al.

(10) Patent No.: US 7,975,479 B2
(45) Date of Patent: Jul. 12, 2011

(54) BI-MATERIAL CORROSIVE RESISTANT HEAT EXCHANGER

(75) Inventors: Orhan Altin, Peoria, IL (US); Rishabh Sinha, Peoria, IL (US); Jiubo Ma, Qingdao (CN); Kent Clark Bates, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 926 days.

(21) Appl. No.: 11/797,023

(22) Filed: Apr. 30, 2007

(65) Prior Publication Data

US 2008/0264622 A1 Oct. 30, 2008

(51) Int. Cl.
*F02M 25/07* (2006.01)

(52) U.S. Cl. ..... 60/605.2; 165/144; 165/905

(58) Field of Classification Search ..... 165/133, 165/134.1, 146, 180; 60/605.2
See application file for complete search history.

(56) References Cited

U.S. PATENT DOCUMENTS

| | | | | |
|---|---|---|---|---|
| 3,526,274 | A | 9/1970 | Gardner | |
| 3,880,232 | A | 4/1975 | Parker | |
| 4,210,127 | A | 7/1980 | Kleine et al. | |
| 4,263,966 | A | 4/1981 | Östbo | |
| 4,600,053 | A | 7/1986 | Patel et al. | |
| 4,676,304 | A | 6/1987 | Koisuka et al. | |
| 4,807,588 | A * | 2/1989 | Bentley et al. | 126/110 R |
| 5,148,863 | A | 9/1992 | Fouts et al. | |
| 5,174,370 | A | 12/1992 | Hallgren | |
| 5,178,124 | A * | 1/1993 | Lu et al. | 126/110 R |
| 5,271,376 | A | 12/1993 | Lu et al. | |
| 5,368,090 | A * | 11/1994 | Ungar et al. | 165/110 |
| 5,525,311 | A | 6/1996 | Girod et al. | |
| 5,540,899 | A | 7/1996 | Koves | |
| 5,573,062 | A | 11/1996 | Ooba et al. | |
| 5,582,241 | A * | 12/1996 | Yoho et al. | 165/81 |
| 5,623,988 | A * | 4/1997 | Holowczak et al. | 165/134.1 |
| 5,762,887 | A | 6/1998 | Girod et al. | |
| 5,839,505 | A | 11/1998 | Ludwig et al. | |
| 6,006,741 | A * | 12/1999 | Daddis, Jr. | 126/110 R |
| 6,119,769 | A | 9/2000 | Yu et al. | |
| 6,286,588 | B1 | 9/2001 | Uehara | |
| 6,546,919 | B2 | 4/2003 | Callas et al. | |
| 6,568,465 | B1 | 5/2003 | Meissner et al. | |
| 6,688,292 | B2 | 2/2004 | Ruppel et al. | |
| 2002/0035847 | A1 | 3/2002 | Yundt, Jr. | |
| 2002/0162646 | A1 | 11/2002 | Haasch et al. | |
| 2004/0031592 | A1 * | 2/2004 | Mathias et al. | 165/104.19 |
| 2007/0039322 | A1 * | 2/2007 | Bering et al. | 60/599 |

FOREIGN PATENT DOCUMENTS

| | | |
|---|---|---|
| DE | 101 26 550 | 1/2002 |
| EP | 1 304 159 | 4/2003 |
| FR | 2 704 635 | 11/1994 |
| FR | 2 769 082 | 4/1999 |
| FR | 2 886 392 | 12/2006 |
| GB | 1 399 545 | 7/1975 |
| WO | WO 2006/135335 A1 | 12/2006 |

* cited by examiner

*Primary Examiner* — Allen J Flanigan
(74) *Attorney, Agent, or Firm* — Finnegan, Henderson, Farabow, Garrett & Dunner LLP

(57) ABSTRACT

A heat exchanger for a fluid handling system is disclosed. The heat exchanger may have an inlet configured to receive a fluid at a first temperature, and an outlet configured to discharge the fluid at a second temperature lower than the first. The heat exchanger may also have at least one fluid passageway disposed to conduct the fluid from the inlet to the outlet. The at least one fluid passageway may have a first section fabricated from a first material, and a second section fabricated from a dissimilar second material. At least one of the first and second materials may include a thermally conductive polymer.

14 Claims, 4 Drawing Sheets

BI-MATERIAL CORROSIVE RESISTANT HEAT EXCHANGER

TECHNICAL FIELD

The present disclosure relates generally to a heat exchanger and, more particularly, to a heat exchanger fabricated from multiple dissimilar materials having corrosion resisting characteristics.

BACKGROUND

Heat exchangers such as, for example, corrugated plate-type exchangers, shell and tube-type exchangers, tube and fin-type exchangers, and other types of heat exchangers known in the art are used to transfer thermal energy between two fluids without direct contact between the two fluids. In particular, a primary fluid is typically directed through a fluid passageway of the heat exchanger, while a cooling or heating fluid is brought into external contact with the fluid passageway. In this manner, heat may be conducted through walls of the fluid passageway to thereby transfer energy between the two fluids. One typical application of a heat exchanger is related to an engine and involves the cooling of air drawn into the engine and/or exhausted from the engine.

As engine manufacturers are continually urged to increase fuel economy, meet lower emission regulations, and provide greater power densities, the pressure and temperature differentials across the heat exchangers are increasing. In addition, due, at least in part, to the increasing pressure and/or temperature differentials found in today's heat exchangers, acidic condensation on and corrosion of the exchanger's fluid passageways are also increasing. As a result, today's heat exchangers are either unable to withstand the extreme conditions or are fabricated from exotic alloys that can withstand the pressure, temperature, and acidic extremes. Subsequently, the heat exchangers either fail, or are so heavy, expensive, and difficult to manufacture that they become impractical for most applications.

One solution to the above-described problems may include the use of a multi-material heat exchanger. One such heat exchanger is described in U.S. Pat. No. 3,880,232 (the '232 patent), issued to Parker on Apr. 29, 1975. In particular, the '232 patent discloses a counter-flow recuperative heat exchanger in which the material composition of the fins and plates within the exchanger vary in the flow direction according to temperature and stress conditions. Specifically, a first plate of high stress- and heat-resistance quality material, such as Inconel, is welded edgewise to a second plate of lower stress- and heat-resistance quality material, such as SAE 1020 steel, which in turn may be edge-welded to another plate of still lesser quality material. A plurality of such elements formed as plates and fins are then fabricated into a unitary heat exchanger core and arranged in a position whereby the sections of the elements having the high stress and heat-resistance qualities are at the higher temperature end of the heat exchanger. By utilizing multiple materials of differing stress and heat-resistance qualities, a lower cost yet durable exchanger may be fabricated.

Although the heat exchanger of the '232 patent may be low cost, as compared to an all-Inconel heat exchanger, and have greater heat-resistance, as compared to an all-steel (SAE 1020 steel) heat exchanger, its applicability may be limited. Specifically, the heat exchanger of the '232 patent may only be beneficial where high temperatures are problematic. In situations where cooler temperatures result in acidic condensation on the passageways of the exchanger, the multi-material heat exchanger of the '232 patent may provide little improvement, if any, over a single material heat exchanger.

The disclosed heat exchanger is directed to overcoming one or more of the problems set forth above.

SUMMARY OF THE INVENTION

In one aspect, the present disclosure is directed to a heat exchanger. The heat exchanger may include an inlet configured to receive a fluid at a first temperature, and an outlet configured to discharge the fluid at a second temperature lower than the first. The heat exchanger may also include at least one fluid passageway disposed to conduct the fluid from the inlet to the outlet. The at least one fluid passageway may include a first section fabricated from a first material, and a second section fabricated from a dissimilar second material. At least one of the first and second materials may include a thermally conductive polymer.

In another aspect, the present disclosure is directed to another heat exchanger. This heat exchanger may include an inlet configured to receive a fluid at a first temperature, and an outlet configured to discharge the fluid at a second temperature lower than the first. The heat exchanger may also include at least one fluid passageway disposed to conduct the fluid from the inlet to the outlet. The at least one fluid passageway may include an upstream section fabricated from a first material, and a downstream section fabricated from a dissimilar second material. The first material may have higher heat resistance than the second material, and the second material may have higher acidic corrosion resistance than the first material.

DETAILED DESCRIPTION

Figure 1:
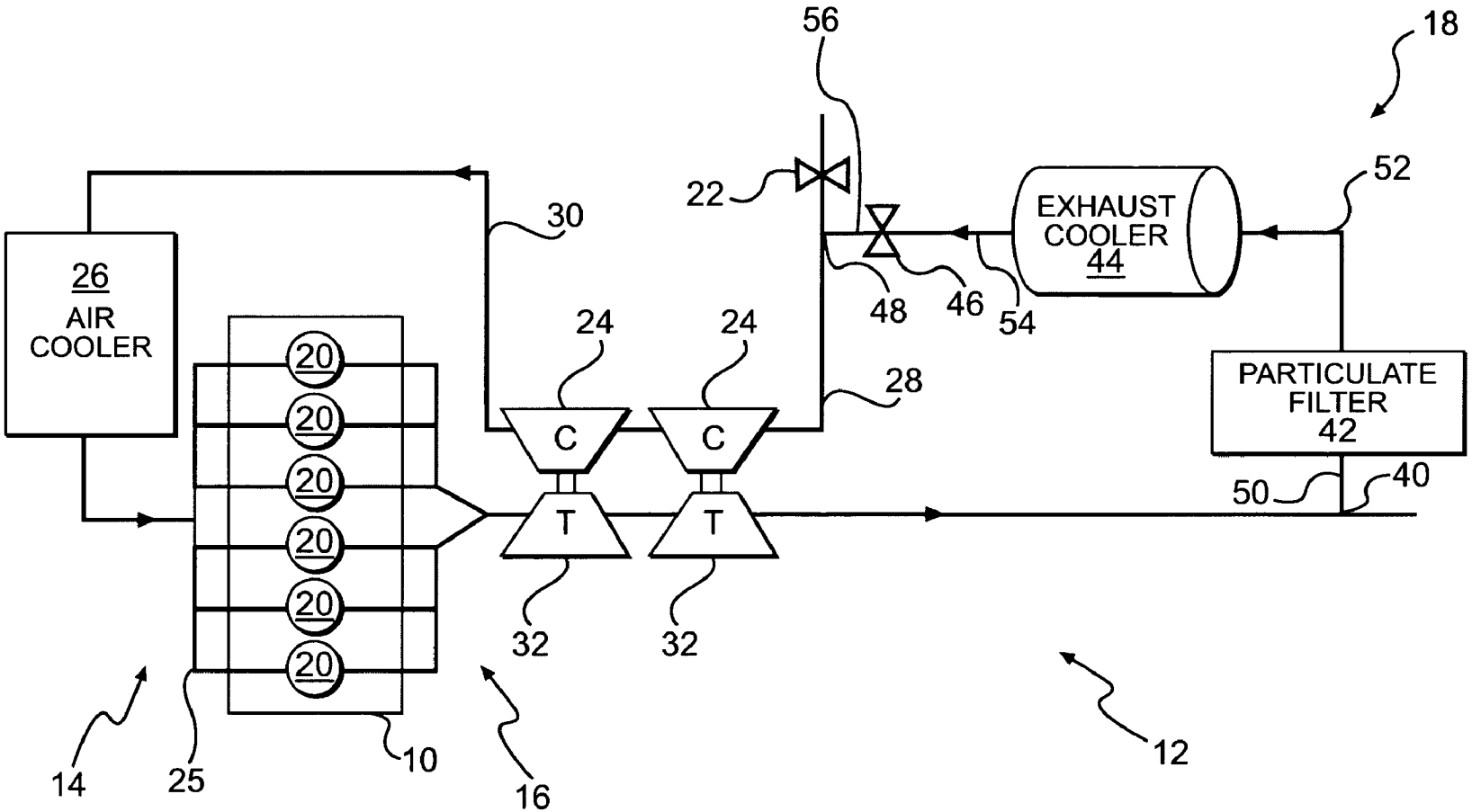
FIG. 1 is a diagrammatic illustration of a power source having an exemplary disclosed fluid handling system.

FIG. 1 illustrates a power source 10 having an exemplary fluid handling system 12. Power source 10 may include an engine such as, for example, a diesel engine, a gasoline engine, a gaseous fuel-powered engine such as a natural gas engine, or any other type of combustion engine apparent to one skilled in the art. Power source 10 may, alternatively, include another source of power, such as, for example, a furnace. Fluid handling system 12 may direct air into and exhaust away from power source 10, and may include an exhaust system 16, a recirculation system 18, and an air induction system 14.

Exhaust system 16 may include a means for directing exhaust flow out of power source 10. For example, exhaust system 16 may include one or more turbines 32 fluidly communicated in a series relationship. Each turbine 32 may be connected to one or more compressors 24 of air induction system 14 to drive the connected compressor 24. In particular, as the hot exhaust gases exiting power source 10 expand against blades (not shown) of turbine 32, turbine 32 may rotate and drive the connected compressor 24. It is contemplated that turbines 32 may alternatively be disposed in a parallel relationship or that only a single turbine 32 may be included within exhaust system 16. It is also contemplated that turbines 32 may be omitted and compressors 24 driven by power source 10 mechanically, hydraulically, electrically, or in any other manner known in the art, if desired.

Recirculation system 18 may include a means for redirecting a portion of the exhaust flow of power source 10 from exhaust system 16 into air induction system 14. For example, recirculation system 18 may include an inlet port 40, a recirculation particulate filter 42, an exhaust cooler 44, a recirculation valve 46, and a discharge port 48. It is contemplated that recirculation system 18 may include additional or different components such as a catalyst, an electrostatic precipitation device, a shield gas system, one or more sensing elements, and other means for redirecting that are known in the art.

Inlet port 40 may be connected to exhaust system 16 to receive at least a portion of the exhaust flow from power source 10. Specifically, inlet port 40 may be disposed downstream of turbines 32 to receive low pressure exhaust gases from turbines 32. It is contemplated that inlet port 40 may alternatively be located upstream of turbines 32 for a high pressure recirculation application, if desired.

Recirculation particulate filter 42 may be connected to inlet port 40 via a passageway 50 to remove particulates from the portion of the exhaust flow directed through inlet port 40. Recirculation particulate filter 42 may include electrically conductive or non-conductive coarse mesh elements. It is contemplated that recirculation particulate filter 42 may include a catalyst for reducing an ignition temperature of the particulate matter trapped by recirculation particulate filter 42, a means for regenerating the particulate matter trapped by recirculation particulate filter 42, or both a catalyst and a means for regenerating. The means for regenerating may include, among other things, a fuel-powered burner, an electrically-resistive heater, an engine control strategy, or any other means for regenerating known in the art. It is contemplated that recirculation particulate filter 42 may be omitted, if desired.

Exhaust cooler 44 may be fluidly connected to recirculation particulate filter 42 via a passageway 52 to cool the portion of exhaust gases flowing through inlet port 40. Exhaust cooler 44 may include a liquid-to-air heat exchanger, an air-to-air heat exchanger, or any other type of heat exchanger known in the art for cooling an exhaust flow. It is contemplated that exhaust cooler 44 may be omitted, if desired.

Recirculation valve 46 may be fluidly connected to exhaust cooler 44 via a passageway 54 to regulate the flow of exhaust through recirculation system 18. Recirculation valve 46 may embody a butterfly valve, a gate valve, a ball valve, a globe valve, or any other valve known in the art. Recirculation valve 46 may be solenoid-actuated, hydraulically-actuated, pneumatically-actuated, or actuated in any other manner.

Air induction system 14 may include a means for introducing cooled charged air into a combustion chamber 20 of power source 10. For example, air induction system 14 may include an induction valve 22, compressors 24, an air cooler 26, and an intake manifold 25. It is contemplated that additional components may be included within air induction system 14 such as, for example, additional valving, one or more air cleaners, one or more waste gates, a control system, and other means for introducing charged air into combustion chambers 20 that are known in the art.

Induction valve 22 may be fluidly connected to compressors 24 via a passageway 28 to regulate the flow of atmospheric air to power source 10. Induction valve 22 may embody a butterfly valve, a gate valve, a ball valve, a globe valve, or any other type of valve known in the art. Induction valve 22 may be solenoid-actuated, hydraulically-actuated, pneumatically-actuated, or actuated in any other manner. Induction valve 22 may be in communication with a controller (not shown) and selectively actuated in response to one or more predetermined conditions.

Compressors 24 may compress the air flowing into power source 10 to a predetermined pressure level. Compressors 24 may be disposed in a series relationship and fluidly connected to power source 10 via a passageway 30. Each of compressors 24 may include a fixed geometry compressor, a variable geometry compressor, or any other type of compressor known in the art. It is contemplated that compressors 24 may alternatively be disposed in a parallel relationship or that air induction system 14 may include only a single compressor 24. It is further contemplated that compressors 24 may be omitted, when a non-pressurized air induction system is desired.

Air cooler 26 may embody an air-to-air heat exchanger or an air-to-liquid heat exchanger and may facilitate the transfer of thermal energy to or from the exhaust gases and/or air directed into power source 10. For example, air cooler 26 may include a shell and tube-type heat exchanger, a corrugated plate-type heat exchanger, a tube and fin-type heat exchanger, a bar-and-plate type heat exchanger, or any other type of heat exchanger known in the art. Air cooler 26 may be located upstream or downstream of compressors 24. It is also contemplated that air induction system 14 may include two coolers, one located upstream and one located downstream of compressors 24. Air cooler 26 may be connected to power source 10 via an intake manifold 25.

Figure 2:
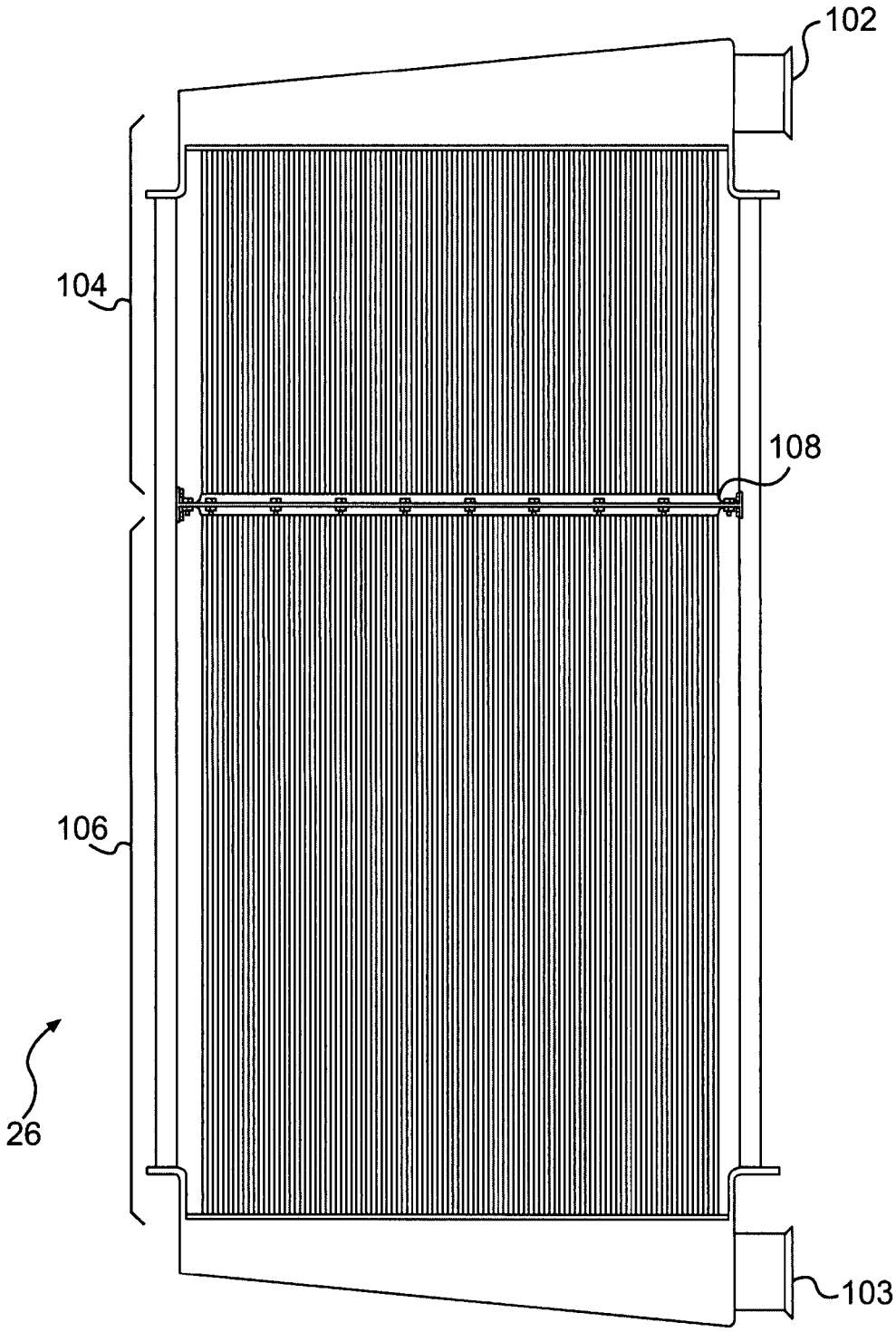
FIG. 2 is a pictorial illustration of an exemplary disclosed heat exchanger for use with the fluid handling system of FIG. 1.

As shown in FIG. 2, air cooler 26 may include an inlet 102, an outlet 103, a first section 104, a second section 106 and a center manifold 108. Inlet 102 may direct the exhaust gases and/or air from compressors 24 into air cooler 26. Outlet 103 may direct the exhaust gases and/or air out of air cooler 26. First section 104 and second section 106 may be joined by way of center manifold 108 to direct the exhaust gases and/or air from inlet 102 to outlet 103 (it is considered that more than two sections may be used in air cooler 26 that are joined with additional manifolds). Specifically, first section 104 may conduct compressed recirculated exhaust gases and/or air from inlet 102 to center manifold 108, while second section 106 may conduct the exhaust gases and/or air from center manifold 108 to outlet 103. The division between first section 104 and second section 106 may be transverse to the direction of fluid flow.

Figure 3:
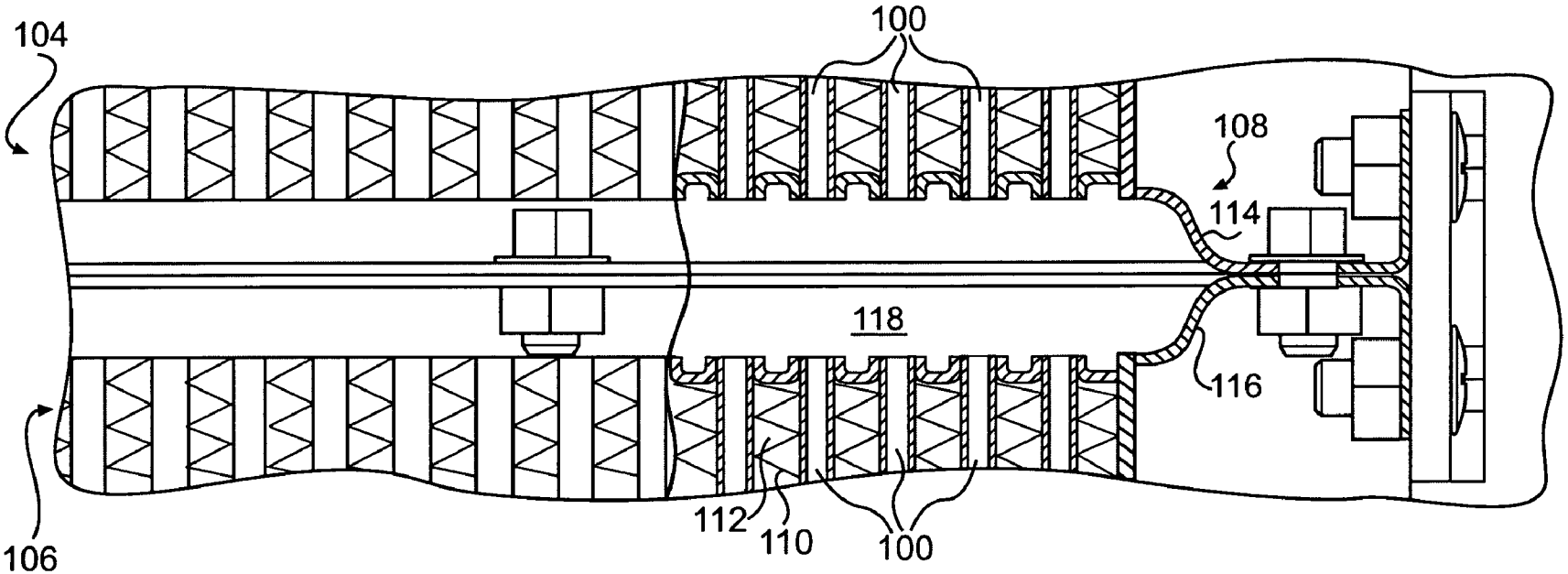
FIG. 3 is a zoomed-in illustration of a section of the heat exchanger of FIG. 1.
Figure 4:
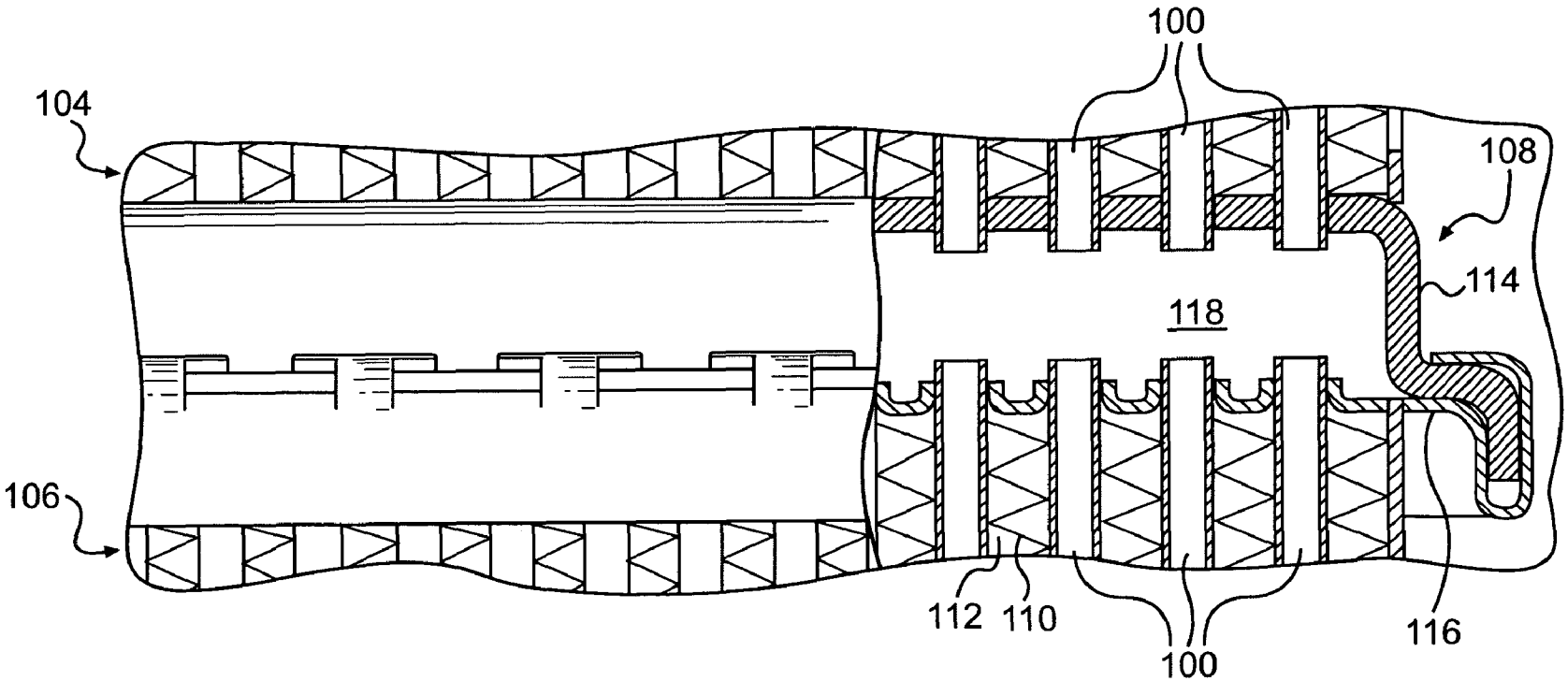
FIG. 4 is a zoomed-in pictorial illustration of another exemplary disclosed heat exchanger for use with the fluid handling system of FIG. 1.

As illustrated in FIGS. 3 and 4, each section (i.e., first section 104 and second section 106) may include spaced apart fluid passageways 100 that are fabricated to have a desired set of thermal and corrosion properties. Fluid passageways 100 may be hollow members such as, for example tubes, slots, or assemblies of plates having mating corrugations. As the recirculated exhaust gases and/or air flow through fluid passageways 100, a cooling medium such as air, water, glycol, a blended air mixture, a water/glycol mixture, a high pressure refrigerant, or any other suitable medium may contact and flow past external surfaces of fluid passageways 100 (e.g., through the spaces between fluid passageways 100). It is contemplated that the cooling medium may flow in any direction relative to the flow of the recirculated exhaust gases and/or air, such as parallel the flow, counter the flow, or across the flow. Fluid passageways 100 may be thermally conductive such that energy from the higher temperature recirculated exhaust gases and/or air may be transferred through the walls of fluid passageways 100 to the lower temperature cooling medium.

A plurality of fins 110 may be attached to or otherwise in contact with the exterior surface of fluid passageways 100 to provide enhanced heat transfer. The geometry of fins 110 may increase the available heat transfer surface area, thus allowing for an increased rate of energy transfer from the higher temperature recirculated exhaust gases and/or air to the lower temperature cooling medium. Fins 110 may be fabricated from a thermally conductive material such as aluminum, copper, stainless steel, or thermally conductive polymer. It is contemplated that fins 110 may or may not be fabricated from the same material as fluid passageways 100. Fins 110 may be arranged substantially orthogonal to the length direction of fluid passageways 100. Fins 110 may be located between adjacent rows of fluid passageways 100 such that the external cooling medium may pass through a plurality of channels 112 formed between fins 110. The heat may be conducted through the walls of fluid passageways 100 to fins 110, and from fins 110 into the external cooling medium. It is considered that fins 110 may be any geometry connected to the exterior surface of fluid passageways 100 such that the heat transfer from fluid passageways 100 may be improved. In one example, fins 110 may be shaped and oriented to form trapezoidal or triangular channels 112. It is also considered that fins 110 may be attached to the interior of fluid passageways 100 (not shown). Fluid passageways 100 may also have surface enhancements such as dimples (not shown), on the interior and/or exterior of fluid passageways 100 to enhance heat transfer.

Fluid passageways 100 of first and second sections 104 and 106 may be fluidly coupled by way of center manifold 108. Center manifold 108 may be located between first section 104 and second section 106 such that fluid passageways 100 of first section 104 conduct fluid into center manifold 108 where it is subsequently received by fluid passageways 100 of second section 106. Center manifold 108 may be manufactured such that it has two connected members. Specifically, a first member 114 of center manifold 108 may be integrated into first section 104, and a second member 116 of center manifold 108 may be integrated into second section 106. When first section 104 and second section 106 are joined (by joining first member 114 and second member 116) a manifold chamber 118 may be formed. A sealing member, such as a gasket or an o-ring (not shown), may be used to ensure proper fluidic sealing between the junction of manifold members 114 and 116 or between center manifold 108 and first and second section 104 and 106. The gasket or o-ring may be fabricated from a material having sufficient corrosion and/or thermal resistance. It is considered that air cooler 26 may alternatively be a single unit. In this embodiment, fluid passageways 100 of first section 104 and second section 106 may be directly coupled without the use of center manifold 108. It is also considered that center manifold 108 may only have a single member that attaches to both first section 104 and second section 106.

The height of center manifold 108 (i.e., the distance between first section 104 and second section 106) may be selected to provide proper flow alignment and avoid a large pressure loss in the flow of fluid between first section 104 and second section 106. For example, when fluid passageways 100 of first section 104 are aligned with fluid passageways 100 of second section 106, the height of center manifold 108 may be small because the exhaust gases and/or air may flow essentially in a direct path from each fluid passageway 100 of first section 104 to a corresponding fluid passageway 100 of second section 106. Alternatively, when fluid passageways 100 of first section 104 are axially offset from fluid passageways 100 of second section 106, the flow of the exhaust gases and/or air may be impeded from flowing in an essentially direct path from each fluid passageway 100 of first section 104 to the corresponding fluid passageway 100 of second section 106. This interruption of flow may cause pressure loss. To avoid pressure loss when passageways 100 of sections 104 and 106 are axially offset, the height of center manifold 108 may be at least twice the minimum dimension of fluid passageways 100 (e.g., when passageways 100 have a rectangular cross section, the minimum dimension may be the smaller of the two sides of the rectangle).

The components of air cooler 26 may be fabricated from materials having different thermal characteristics (e.g., heat resistance and thermal conductivity), anti-corrosive characteristics, mechanical strength, cost, and density characteristics. For example, fluid passageways 100 of first section 104 (e.g., the section of fluid passageways 100 nearest inlet 102) may be fabricated from a first material, and fluid passageways 100 of second section 106 (e.g., the section of fluid passageways 100 nearest outlet 103) may be fabricated from a dissimilar second material. It is contemplated that the material of first section 104 may be selected to provide good heat resistance properties (i.e., material that withstands high temperatures and/or large temperature gradients), while the material of second section 106 may be selected to provide good corrosion properties (i.e., material that resists acidic corrosion).

In one embodiment, this combination of materials may include a thermally conductive polymer and a metal. For example, first section 104 may be fabricated from the metal material, while second section 106 may be fabricated from the thermally conductive polymer. The metal material of first section 104 may have a lower resistance to acidic corrosion than the thermally conductive polymer of second section 106, but better thermal characteristics than the thermally conductive polymer. The selection of the metal material may vary depending on the required degree of heat resistance. For example, when the metal material is subjected to high temperatures, which may occur at high altitudes, a more heat resistant metal like stainless steel may be required. However, when the metal material is subjected to lower temperatures, which may occur at lower altitudes, a relatively less heat resistant metal, like aluminum, may be sufficient. The metal material of first section 104 may also be copper, brass, copper-nickel or another material known in the art. It is also contemplated that other combinations are possible that achieve the desired heat and corrosion resistance properties, such as using polymer materials for both first section 104 and second section 106.

The thermally conductive polymer used in second section 106 may provide for better resistance to acidic corrosion than the metal material of first section 104. Different thermally conductive polymer materials may be used to meet the thermal conductivity and acidic corrosion requirements for the given air cooler application. If a thermally conductive polymer is used to fabricate fluid passageways 100, a metallic frame or casing may be used to support one or more of fluid passageways 100.

In another embodiment, fluid passageways 100 of first section 104 and second section 106 may both be fabricated from metal materials, where the metal material of first section 104 is selected to provide good heat resistance properties, and the metal material of second section 106 is selected to provide good corrosion properties. The heat resistant metal material used in first section 104 may be, for example, stainless steel or copper. The corrosion resistant metal material used in second section 106 may be stainless steel or aluminum. It is also considered that the metal materials used in first section 104 and/or second section 106 may also include alloys of the metal materials.

The integration of first member 114 and second member 116 into first section 104 and second section 106 respectively, may be achieved by welding, brazing, soldering, mechanical fastening, or any other method known in the art. Similarly, first and second sections 104 and 106 may be joined at center manifold 108 through welding, brazing, chemical bonding, or mechanical fastening. The mechanical fastening techniques may include bolting, crimping, and mechanical expansion, where mechanical expansion is to be interpreted as the expansion of one element to press against another, this pressing exerting enough friction to retain both elements in engagement. FIG. 3 illustrates an example of center manifold 108 being joined by bolting, and FIG. 4 illustrates an example of center manifold 108 being joined by crimping. The type of fastening method used for air cooler 26 may be dependent on the type of materials selected for first and second sections 104 and 106, as well as the type of material selected for center manifold 108. For example, some metals and plastics may not be conducive to welding or brazing and, thus, may be joined using mechanical fastening methods. Welding, brazing, and chemical bonding may be used as permanent fastening methods where air cooler 26 is not intended to be disassembled, whereas bolting may be used where separation of first section 104, second section 106, and center manifold 108 is desired.

Further, the materials of first section 104, second section 106, and center manifold 108, as well as the fastening method used to fasten these sections and center manifold 108, may be chosen such that subsequent thermal stresses created during the operation of fluid handling system 12 do not fracture and fatigue the materials of these components. For example, the upper and lower pieces of center manifold 108 may be directly welded together. In this configuration, thermal stresses at or near the welded junctions may be prevented by selecting materials for upper member 114 and lower member 116 that experience similar rates and magnitudes of thermal expansion when subjected to temperature variations during the operation of air cooler 26. It is also considered that, for given materials, the fastening method may be selected to relieve thermal stresses. For example, when certain materials are selected to meet the thermal and corrosion resistance requirements, but the selected materials have different rates and magnitudes of thermal expansion, mechanical fastening methods, such as, for example, crimping and bolting, may be used to relieve thermal stresses. Thermal expansion related stresses created when using welding, mechanical fastening methods, brazing, or chemical fastening methods may be further minimized via proper geometric design. It is also considered that the structural stresses created by other operating conditions (i.e., vibration, pressure) may affect the material selection and fastening methods used for first section 104, second section 106, and center manifold 108.

It is contemplated that the types, pressures, temperatures, and flow rates of fluids directed through air cooler 26 may determine the respective lengths of first section 104 and second section 106. For example, if a high temperature application of air cooler 26 is expected, the length of first section 104 may be increased to allow for more heat transfer from the interior fluid to the exterior cooling medium before the exhaust gases and/or air reach second section 106, which may be manufactured from a lower heat resistance material. Assuming a higher corrosion resistance material in second section 106 and lower corrosion resistance material in first section 104, the lengths of first section 104 and second section 106 may also be adjusted such that the majority of the condensation from the exhaust gases and/or air mixture is deposited in second section 106. The selection of both the lengths of first and second sections 104 and 106, as well as the materials of each, may be chosen to balance the heat resistance and corrosion resistance objectives for the particular application. In one embodiment, the length of first section 104 may be about one third the total length of air cooler 26 or about half the length of second section 106.

INDUSTRIAL APPLICABILITY

The disclosed fluid handling system may be implemented in any cooling or heating application where cost and component life may be a consideration. Specifically, the materials used in the heat exchanger of the disclosed system may have good heat resistance properties where necessary, and good corrosion resistance properties where necessary. By providing materials having these properties only where necessary, the disclosed system may benefit from extended component life, decreased cost, and decreased weight. The operation of fluid handling system 12 will now be explained.

Atmospheric air may be drawn into air induction system 14 via induction valve 22 to compressors 24 where it may be pressurized to a predetermined level before entering combustion chambers 20 of power source 10. Fuel may be mixed with the pressurized air before or after entering combustion chambers 20. This fuel-air mixture may then be combusted by power source 10 to produce mechanical work and an exhaust flow containing gaseous compounds and solid particulate matter. The exhaust flow may be directed from power source 10 to turbines 32 where the expansion of hot exhaust gases may cause turbines 32 to rotate, thereby rotating connected compressors 24 and compressing the inlet air. After exiting turbines 32, the exhaust gas flow may be divided into two flows, including a first flow redirected back to air induction system 14 and a second flow directed to the atmosphere.

As the first exhaust flow moves through inlet port 40 of recirculation system 18, it may be filtered by recirculation particulate filter 42 to remove particulate matter prior to communication with exhaust cooler 44. The particulate matter, when deposited on the mesh elements of recirculation particulate filter 42, may be passively and/or actively regenerated.

The flow of the reduced-particulate exhaust from recirculation particulate filter 42 may be cooled by exhaust cooler 44 to a predetermined temperature and then directed through recirculation valve 46 to be drawn back into air induction system 14 by compressors 24. The recirculated exhaust flow may then be mixed with the air entering combustion chambers 20. The exhaust gas, which is directed to combustion chambers 20, may reduce the concentration of oxygen therein, which in turn lowers the maximum combustion temperature within power source 10. The lowered maximum combustion temperature may slow the chemical reaction of the combustion process, thereby decreasing the formation of nitrous oxides. In this manner, the gaseous pollution produced by power source 10 may be reduced. The lower peak combustion temperature may also result in improved efficiency of power source 10 by reducing heat rejection and chemical disassociation.

Prior to entering power source 10, the mixture of exhaust gases and/or air may be cooled using air cooler 26 so as to improve the longevity, performance, and emission characteristics of power source 10. However, in certain applications, such as high altitude applications, the gases entering inlet 102 may be at extremely high temperatures. Thus, first section 104 may be fabricated from heat resistant material to avoid melting and/or other heat induced damage. As the mixture of inlet air and recirculated exhaust gases flows through air cooler 26, heat may be transferred from the higher temperature exhaust gases and/or air mixture to the lower temperature cooling fluid exterior to fluid passageways 100. As the mixture travels along the length of fluid passageways 100 from inlet 102 to outlet 103 of air cooler 26, the mixture may cool to a lower and lower temperature thus allowing second section 106 to be constructed of a lower heat resistance material.

Further, as the mixture of inlet air and recirculated exhaust gases flows through air cooler 26, vapor from the cooling mixture may condense on the interior surfaces of fluid passageways 100. That is, as the mixture travels along the length of fluid passageways 100 from inlet 102 to outlet 103 of air cooler 26, the mixture may cool to a lower and lower temperature and, because the vapor pressure of the mixture may decrease with decreasing temperature, more vapor from the cooling mixture may condense within second section 106 than in first section 104. This condensation within second section 106 may form corrosive substances. For example, sulfur dioxide and trioxide (SO2 and SO3) and nitrous oxides (NOX) in the exhaust gas may react with the condensed water vapor and form sulfuric and nitric acid. The sulfuric acid may contact the walls of fluid passageways 100, and if left unchecked, may eventually corrode away fluid passageways 100, resulting in system rupture and/or contamination. To improve the life of air cooler 26, fluid passageways 100 of second section 106 may be fabricated from a corrosion resistant material, such as a thermally conductive polymer or aluminum.

Because different materials may be selected for the fabrication of first section 104 and second section 106 to achieve the desired anti-corrosive and heat-resistance characteristics, the cost of air cooler 26 may be minimized while still achieving good performance characteristics. For example, since the material of first section 104 may be selected with the principle consideration being good heat resistance, a more inexpensive material may be selected when compared to a material that is required to have both good heat resistance and good corrosion resistance. Similarly, the material for second section 106 may be selected primarily for its corrosion resistance properties rather than its combined corrosion resistance and heat resistance properties. This reduction in the design requirements for each section of air cooler 26 may also allow for an overall weight reduction of air cooler 26 (i.e., allow for selection of materials with lower densities in one or both of first and second sections 104 and 106).

It will be apparent to those skilled in the art that various modifications and variations can be made to the disclosed fluid handling system. Other embodiments will be apparent to those skilled in the art from consideration of the specification and practice of the disclosed fluid handling system. For example, although air cooler 26 is depicted and described as an air-to-air or air-to-liquid heat exchanger, it is contemplated that fluid passageways 100 having the predetermined corrosion and heat resistance characteristics may be equally applicable to a liquid-to-liquid type of heat exchanger. In addition, although primarily described in relation to air cooler 26, first and second sections 104 and 106 having fluid passageways 100 fabricated from optimally selected materials may also be utilized in connection with, for example, exhaust cooler 44. It is intended that the specification and examples be considered as exemplary only, with a true scope being indicated by the following claims and their equivalents.

What is claimed is:

1. A heat exchanger, comprising:

an inlet configured to receive a fluid at a first temperature;

an outlet configured to discharge the fluid at a second temperature lower than the first; and a plurality of first fluid passageways disposed to conduct the fluid from the inlet to a manifold chamber, the first fluid passageways forming a first section fabricated from a metal material, the manifold chamber providing communication between the first fluid passageways and a plurality of second fluid passageways, the second fluid passageways forming a second section fabricated from a thermally conductive polymer, each first fluid passageway being linear between the inlet and the manifold chamber, each second fluid passageway being linear between the manifold chamber and the outlet, each first fluid passageway being coaxial with one of the second fluid passageways, and wherein the first fluid passageways have a flow path length of about one half the length of the second passageways.

2. The heat exchanger of claim 1, wherein the second section is located downstream of the first section.

3. The heat exchanger of claim 1, wherein the first section is fabricated from a metal having a lower resistance to acidic corrosion than the thermally conductive polymer.

4. The heat exchanger of claim 3, wherein the first section is fabricated from aluminum.

5. The heat exchanger of claim 3, wherein the first section is fabricated from stainless steel.

6. The heat exchanger of claim 1, wherein the first and second sections are joined by way of mechanical fastening.

7. The heat exchanger of claim 6, wherein mechanical fastening includes bolting.

8. The heat exchanger of claim 6, wherein mechanical fastening includes crimping.

9. A heat exchanger, comprising:

an inlet configured to receive a fluid at a first temperature;

an outlet configured to discharge the fluid at a second temperature lower than the first; and a plurality of first fluid passageway disposed to conduct the fluid from the inlet to a manifold chamber and a plurality of second fluid passageways disposed to conduct fluid from the manifold chamber to the outlet, wherein the first fluid passageways form an upstream section fabricated from a metal material, and the second fluid passageways form a downstream section fabricated from a thermally conductive polymer, the first material having higher heat resistance than the second material and the second material having higher acidic corrosion resistance than the first material, each first fluid passageway being linear between the inlet and the manifold chamber, each second fluid passageway being linear between the manifold chamber and the outlet, each first fluid passageway being coaxial with one of the second fluid passageways, the first fluid passageways having a flow path length about one half the length of the second fluid passageways.

10. The heat exchanger of claim 9, wherein the metal material is at least one of copper and stainless steel.

11. The heat exchanger of claim 9, wherein the upstream and downstream sections are mechanically fastened together.

12. The heat exchanger of claim 9, wherein a height of the manifold chamber being selected to reduce pressure loss between the first and second fluid passageways.

13. The heat exchanger of claim 12, wherein the manifold chamber has a height of at least twice the minimum dimension of the fluid passageways.

14. A fluid handling system for a power source, comprising:

a supply of air;

a supply of recirculated exhaust gas;

a compressor in communication with the supply of air and the supply of recirculated exhaust gas, the compressor being configured to compress a mixture of air and recirculated exhaust gas;

an inlet manifold in fluid communication with the engine; and a heat exchanger configured to cool the compressed air and recirculated exhaust gas mixture and to direct the cooled mixture to the inlet manifold, the heat exchanger including:

an inlet configured to receive the mixture at a first temperature;

an outlet configured to discharge the mixture at a second temperature lower than the first; and a plurality of first fluid passageways disposed to conduct the mixture from the inlet to a manifold chamber and a plurality of second fluid passageways disposed to conduct the mixture from the manifold chamber to the outlet, wherein the first fluid passageways form an upstream section fabricated from a metal material, and the second fluid passageways form a downstream section fabricated from a thermally conductive polymer, each first fluid passageway being linear between the inlet and the manifold chamber, each second fluid passageway being linear between the manifold chamber and the outlet, each first fluid passageway being coaxial with one of the second fluid passageways, the first fluid passageways having a flow path length about one half the flow path length of the second fluid passageways.

* * * * *